US007614573B1

(12) United States Patent
Jean

(10) Patent No.: US 7,614,573 B1
(45) Date of Patent: Nov. 10, 2009

(54) JAW CRUSHER

(75) Inventor: Cheng-Shu Jean, Sanchung (TW)

(73) Assignee: Chyi Meang Machinery Co., Ltd., Taipei County (TW)

( * ) Notice: Subject to any disclaimer, the term of this patent is extended or adjusted under 35 U.S.C. 154(b) by 0 days.

(21) Appl. No.: 12/213,497

(22) Filed: Jun. 20, 2008

(51) Int. Cl.
*B02C 17/14* (2006.01)

(52) U.S. Cl. ..... 241/264; 241/269

(58) Field of Classification Search ..... 241/264, 241/267–269
See application file for complete search history.

(56) References Cited

U.S. PATENT DOCUMENTS 2,532,678 A * 12/1950 Shelton ..... 241/217
4,406,416 A * 9/1983 Tateishi ..... 241/269
4,637,562 A * 1/1987 Hagiwara et al. ..... 241/259.2
4,783,013 A * 11/1988 Polzin ..... 241/219
4,927,089 A * 5/1990 Altmayer ..... 241/264
5,857,630 A * 1/1999 Hamaguchi et al. ..... 241/259.1
2004/0129814 A1* 7/2004 Ha ..... 241/267
2005/0082403 A1* 4/2005 Boast ..... 241/266

* cited by examiner

*Primary Examiner*—Bena Miller
(74) *Attorney, Agent, or Firm*—Rosenberg, Klein & Lee

(57) ABSTRACT

A jaw crusher includes a machine with a moving base, a fixed base, a crush travel adjusting mechanism for pivotally coupling the top of a crush travel adjusting base to the machine by an eccentric sleeve, and an automatic crush gap adjusting mechanism. A toggle plate is installed between the crush travel adjusting base and the moving base. A pull rod of the moving base having a compression spring tightly presses front and rear ends of the toggle plate. The automatic crush gap adjusting mechanism fixes a steel slot of a stop plate and a pair of triangular wedge-shaped lumps to the position adjusting base of the machine, and the stop plate is installed between the steel slot and the crush travel adjusting base, and a pull rod of the adjusting base having a compression spring tightly presses both front and rear ends of the stop plate.

8 Claims, 9 Drawing Sheets

JAW CRUSHER

BACKGROUND OF THE INVENTION

1. Field of the Invention

The present invention relates to a jaw crusher, and more particularly to a jaw crusher with a design of moving the position of a pair of triangular wedge-shaped lumps to set a crush gap and adjust a crush travel distance with an eccentric setting.

2. Description of the Related Art

Jaw crusher is an industrial tool used for crushing substances such as ores extracted from mines, concrete chucks discarded from constructions, asphalt chucks dug out from road surfaces, and slag discharged from steel-making plants. With reference to FIG. 1, the structure of a jaw crusher includes a moving base 20, a fixed base 30 and a gap adjusting mechanism 40 installed to a machine 10, wherein the moving base 20 is installed to the machine 10 through an eccentric shaft 21, and the gap adjusting mechanism 40 abuts the moving base 20 through a toggle plate 41, and a pull rod 22 with a compression spring presses the toggle plate 41 between the moving base 20 and the gap adjusting mechanism 40. A belt pulley 23 driven by a motor turns the eccentric shaft 21, such that the moving base 20 will swing back and turn together with the eccentric shaft 21 to engage a moving die 24 on the moving base 20 with a fixed die 31 on the fixed base 30, so as to repeatedly increase and decrease a crush gap W between the moving die 24 and the fixed die 31 for crushing the substances.

If it is necessary to adjust the crush gap W after the fixed die 31 and the moving die 24 are worn out, or there is a different requirement on the size of the crushing substances, the conventional gap adjusting mechanism 40 is adjusted by loosening the compression spring of the pull rod 22 first, and then a screw rod or a hydraulic cylinder 42 is used for adjusting an adjusting lump 43 to an appropriate position; in other words, the position of the moving die 24 is adjusted by the toggle plate 41, and then the thickness of a padding plate 44 is increased or decreased to a desired thickness, and finally the compression spring of the pull rod 22 is secured to a predetermined compressed length, and the whole procedure of adjusting the crush gap W takes approximately 30-40 minutes.

With reference to FIG. 2 for installing the eccentric shaft 21 of the moving base 20 to the machine 10 in accordance with a prior art, the lower bearing housing 11 is soldered onto a sideboard 12 of the machine 10, and a plurality of reinforced plates 13 are soldered at the bottom the machine 10 and a reinforced rod 14 is soldered at a lateral side of the machine 10 to constitute a heavy construction. However, upper and lower bearing housings 15, 11 cannot provide a uniform support force to an external bearing. Further, the structure of the conventional machine 10 adopts the method of soldering a whole frame, involves a large volume, and incurs a high transportation cost and a high level of difficulty for the transportation.

SUMMARY OF THE INVENTION

It is a primary object of the invention to provide a simple, easy and quick way of setting the crush gap to overcome the shortcomings of the prior art that takes much time and requires a complicated procedure for adjusting the crush gap.

Another object of the invention is to adjust the crushing distance by an eccentric setting method.

A further object of the invention is to achieve the effect of eliminating and absorbing abnormal large load.

Another further object of the invention is to achieve the effect of absorbing the impact of falling crushed substances.

Still another object of the invention is to achieve the effects of uniformly supporting a bearing housing and enhancing the rigidity of frame.

Yet another object of the invention is to achieve the effects of lowering the transportation cost and facilitating the transportation of the machine.

In order to achieve the above-mentioned objects, a jaw crusher in accordance with the invention includes:

a) a moving base, installed to a machine through an eccentric shaft, and having a moving die installed onto a crushing surface;

b) a fixed base, fixed onto the machine, and having a fixed die disposed at a position corresponding to the moving die of the moving base;

c) a crush travel adjusting mechanism, for pivotally coupling the top of a crush travel adjusting base to the machine, and an axle of the crush travel adjusting base being pivotally coupled to the machine through an eccentric sleeve, and a toggle plate being disposed separately on both ends and between the bottom of the crush travel adjusting base and the moving base, and a pull rod of the moving base having a compression spring being provided for tightly pressing front and rear ends of the toggle plate; and d) an automatic crush gap adjusting mechanism, for arranging and fixing a steel slot of the stop plate and a triangular wedge-shaped lump at a position adjusting base of the machine, and installing a stop plate between the steel slot of the stop plate and the middle section of the crush travel adjusting base, and using a pull rod of the adjusting base having an compression spring to tightly press front and rear ends of the stop plate to control the position of the triangular wedge-shaped lump and change the position of the steel slot of the stop plate, so as to set a crush gap between the moving die and the fixed die.

DETAILED DESCRIPTION OF THE PREFERRED EMBODIMENTS

Figure 1:
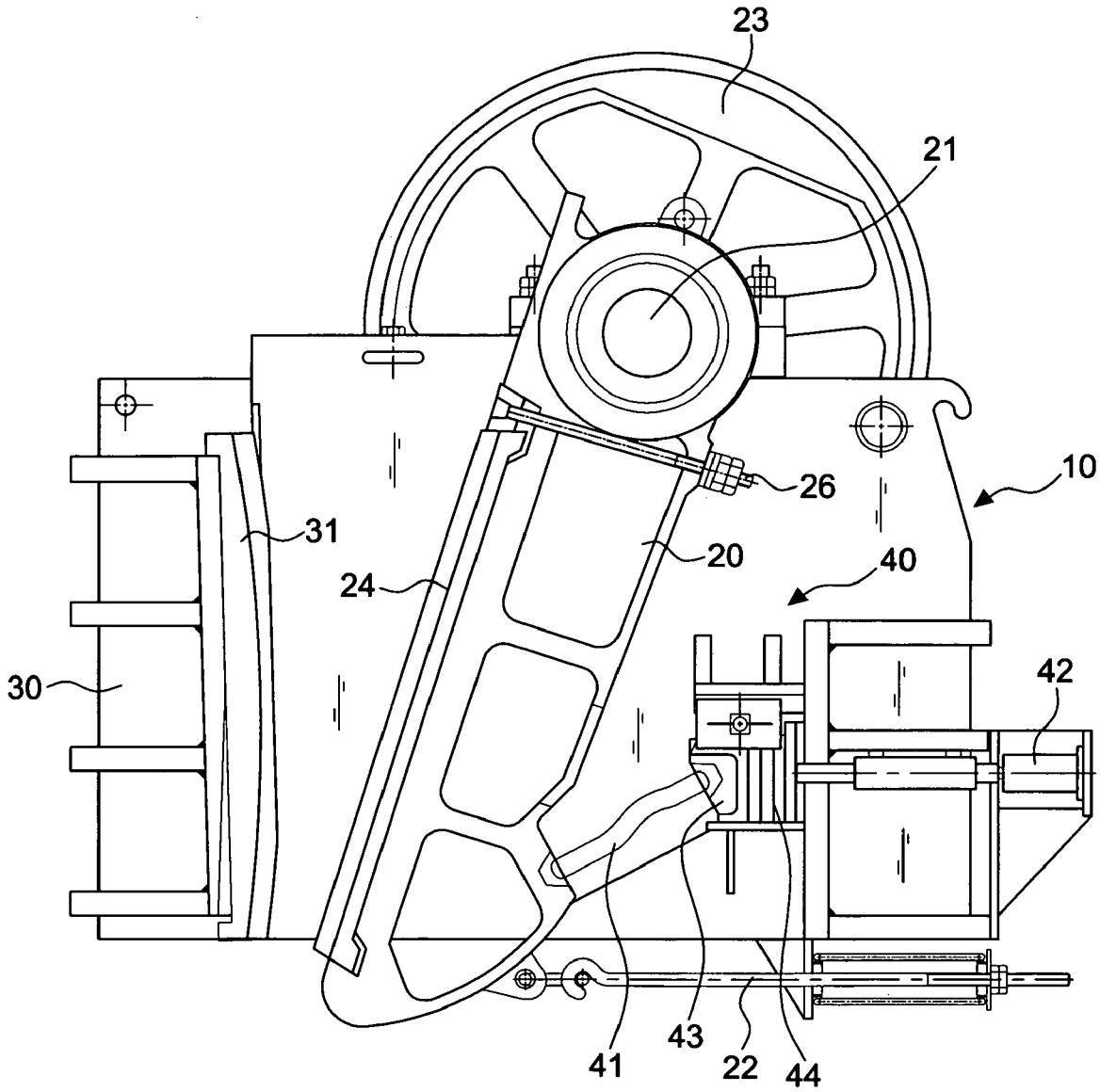
FIG.1 PRIOR ART
FIG. 1 shows a structure of a jaw crusher of a prior art.
Figure 2:
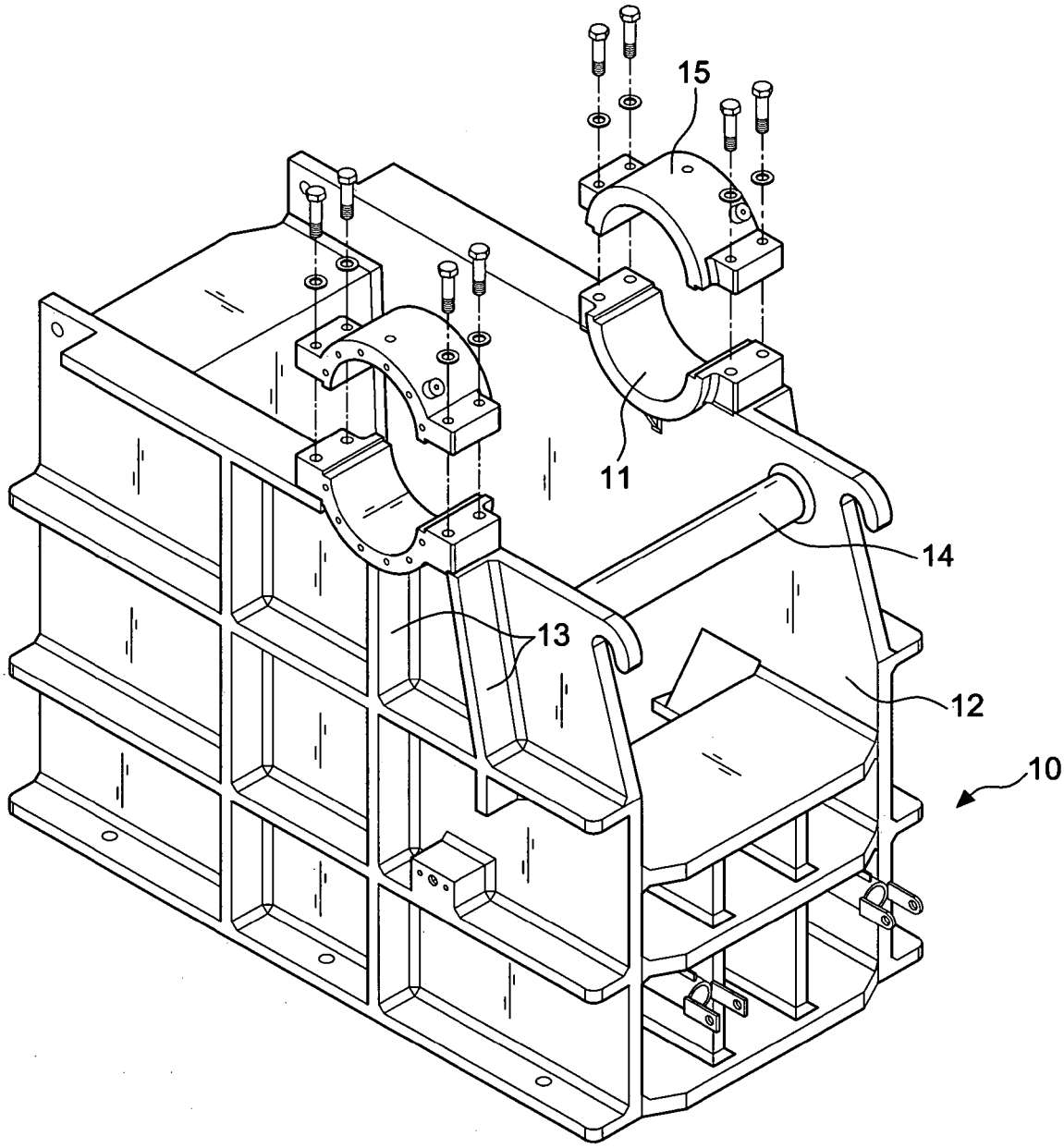
FIG.2 PRIOR ART
FIG. 2 shows a structure of a machine of a jaw crusher of a prior art.
Figure 3:
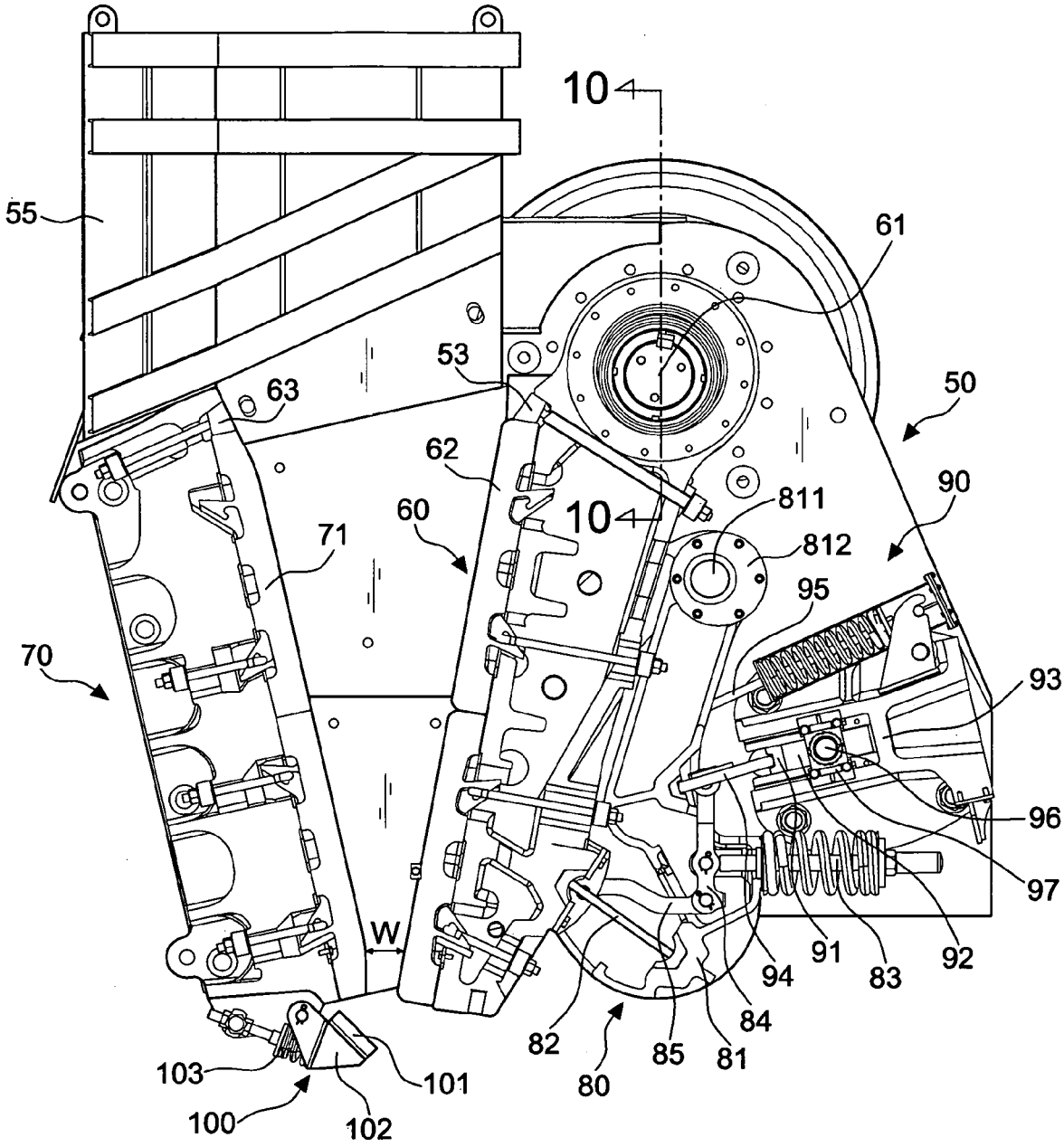
FIG. 3 shows a structure of the invention.
Figure 4:
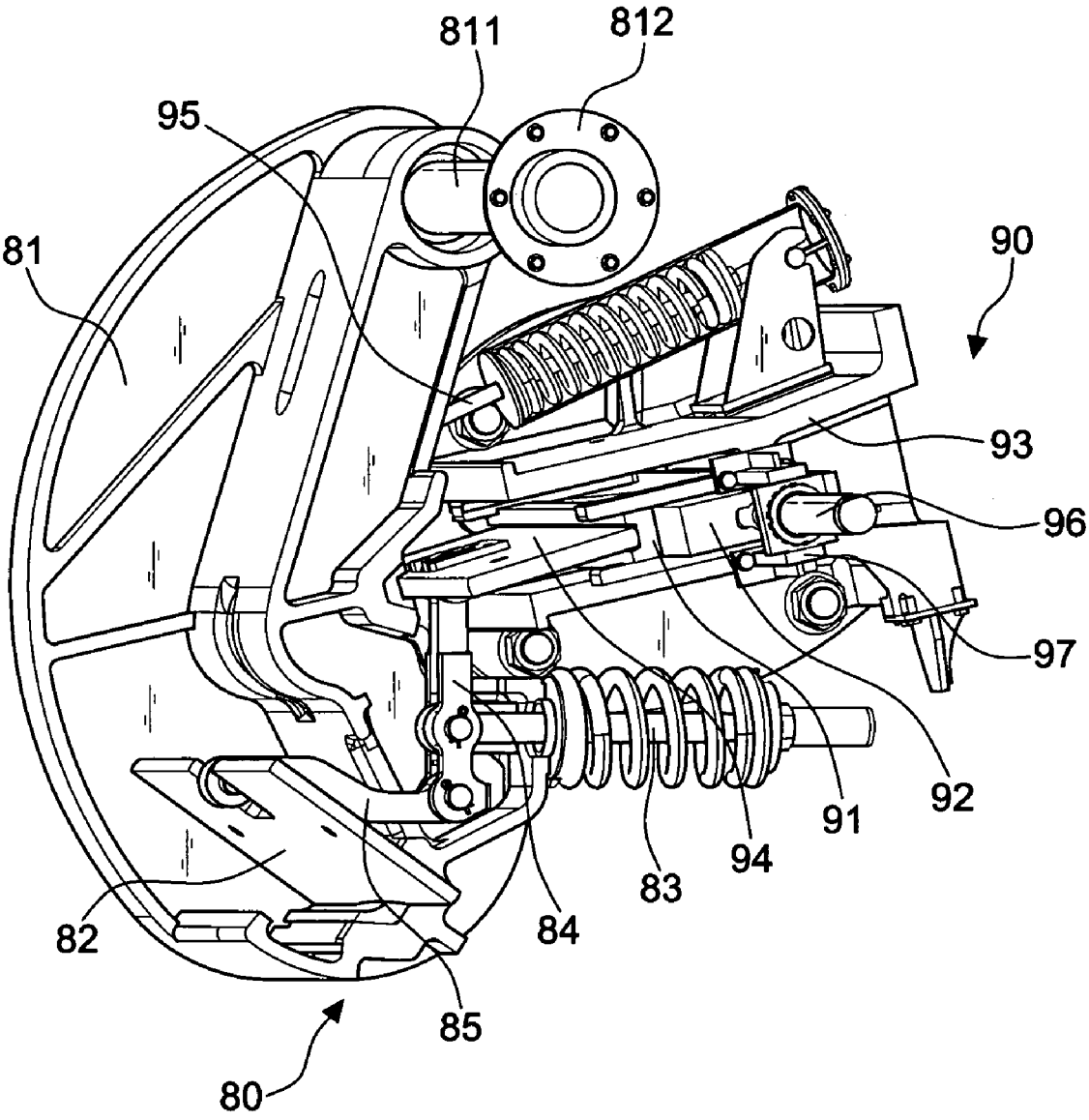
FIG. 4 is a perspective view of structures of a crush travel adjusting mechanism and an automatic crush gap adjusting mechanism in accordance with the invention.

With reference to FIGS. 3 and 4, the jaw crusher of the invention comprises a moving base 60, a fixed base 70, a crush travel adjusting mechanism 80 and an automatic crush gap adjusting mechanism 90, all installed to a machine 50.

The moving base 60 is installed to the machine 50 through an eccentric shaft 61, and a moving die 62 is installed on a crushing surface, and the installation position of the eccentric shaft 61 is shifted towards the rear, and an inserting feed bin 55 collects crushed substances to prevent the crushed substances from impacting a bearing of the moving base 60 directly, so as to extend the life of the bearing.

The fixed base 70 is fixed to the machine 50 and includes a fixed die 71 corresponding to the moving die 62 of the moving base 60.

The crush travel adjusting mechanism 80 is provided for pivotally coupling the top of a crush travel adjusting base 81 to the machine 50, and an axle 811 of the crush travel adjusting base 81 is pivotally coupled to the machine 50 through an eccentric sleeve 812, and internal and external diameters of the eccentric sleeve 812 have an eccentric distance, and a crush travel distance can be changed by adjusting the angle of the eccentric sleeve 812. Further, a toggle plate 82 is installed on both ends of a bottom between the adjusting base 81 and the moving base 60, and a pull rod 83 of the moving base 60 installs a compression spring for tightly pressing the toggle plate 82. Since the fixed end of the toggle plate 82 is disposed at the bottom and the moving end of the toggle plate 82 is disposed at the top, therefore most of the inertia effects is provided by the moving base 60 during the crushing process, and the inertia effect of a belt pulley and a flywheel is smaller than the conventional one, so as to reduce the weight of the belt pulley and the flywheel. Since the crushing travel distance and angle at the bottom of the moving base 60 are moved repeatedly from the moving die 62 to the lower side of the fixed die 71, therefore the life of the fixed die 71 is generally longer than the traditional one. The present invention is a breakthrough, particularly at the time when the price of raw materials is high. In the crushing process of the structure of the toggle plate 82, the moving die 62 is moved repeatedly with respect to the lower side of the fixed die 71. Compared with the traditional structure of repeatedly moving the moving die 62 towards the upper side of the fixed die 71, the crushing effect of the invention is better, and the production capacity is higher. However, a pull rod 83 of the moving base 60 is connected to the first link rod 84, and an end of the first link rod 84 is pivotally coupled to a stop plate 94 of the automatic crush gap adjusting mechanism 90, and another end of the first link rod 84 is coupled to an end of a second rod 85, and another end of the second rod 85 is coupled to the moving base 60.

Figure 5:
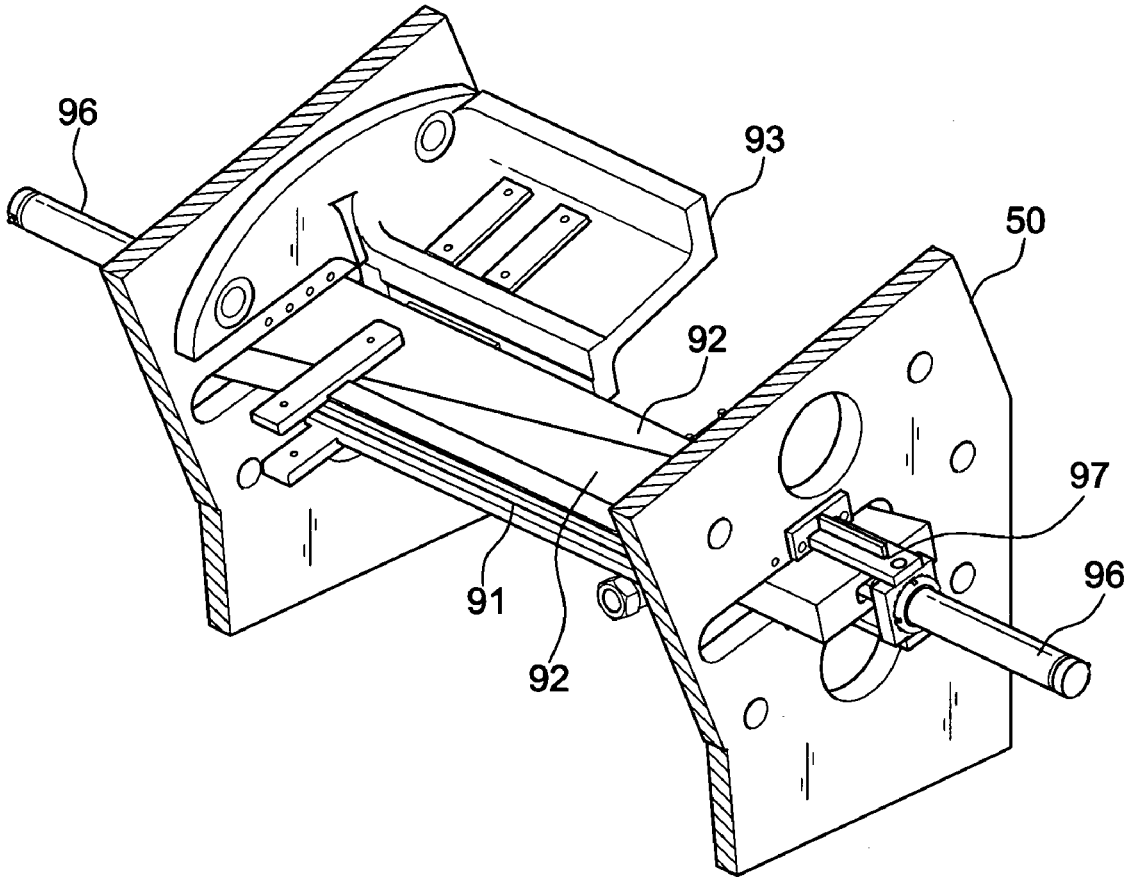
FIG. 5 shows a moving status of a wedge-shaped lump in accordance with the invention.
Figure 6:
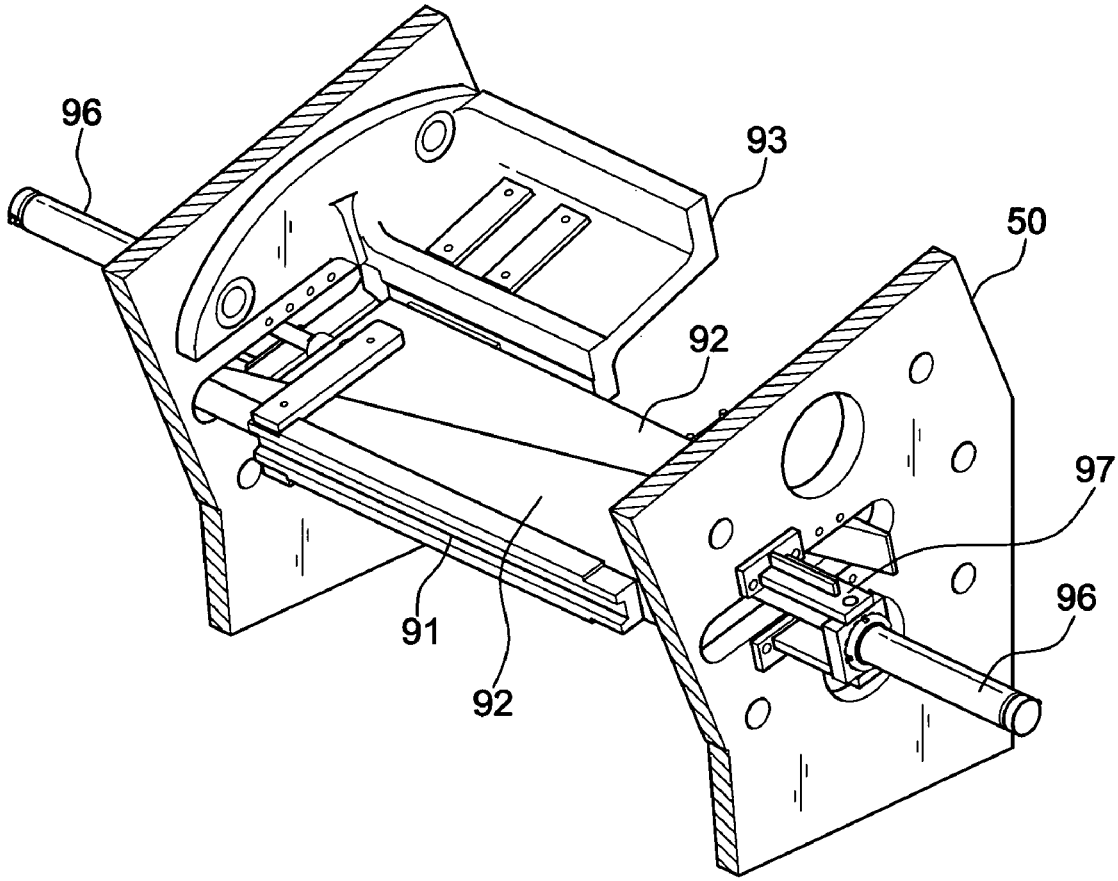
FIG. 6 shows another moving status of a wedge-shaped lump in accordance with the invention.

With reference to FIGS. 5 and 6, the automatic crush gap adjusting mechanism 90 arranges and fixes a steel slot 91 of a stop plate 94 and a pair of triangular wedge-shaped lumps 92 to a position adjusting base 93 of the machine 50 and installs the stop plate 94 between the steel slot 91 of the stop plate 94 and the middle section of the crush travel adjusting base 81. A pull rod 95 of the adjusting base having a compression spring tightly presses the stop plate 94 to adjust the position of the pair of triangular wedge-shaped lumps 92 to change the position of the steel slot 91 of the stop plate 94, such that the crush gap W between the moving die 62 and the fixed die 71 can be set by the stop plate 94, the crush travel adjusting base 81, the toggle plate 82 and the moving base 60. Unlike the traditional structure that requires loosening the spring and securing the spring after the adjustment is made, the present invention provides a more convenient way of adjusting the crush gap without the need of loosening the spring and securing the spring.

In addition, the triangular wedge-shaped lump 92 is connected to a moving end of a pushing rod 96, and a fixed end of the pushing rod 96 is pivotally connected to a support stand 97 of the position adjusting base 93, wherein the pushing rod 96 can be a hydraulic cylinder. However, if an unintended crushing object such as a shovel bucket or a tungsten carbide drill of a rock borer enters into a crushing chamber, the crushing pressure will become very large and exceed the safety setting of a hydraulic circuit, and the triangular wedge-shaped lump 92 will retreat quickly to increase the crush gap and allow the unintended crushing object to pass through the crushing chamber quickly, so as to achieve the effects of preventing a damage to components, protecting the machine, and eliminating an abnormal too-large load.

Further, a blanking shock absorption mechanism 100 installed at a lower lateral side of a blanking opening includes a shock absorption base 102 with an impact plate 101 pivotally coupled to a lower lateral side of the blanking opening, and the shock absorption base 102 is connected to a vibration absorption spring 103 in an opposition direction of the impact plate 101 for absorbing an impact force when crushed substances drop to prevent a direct impact onto the receiving components or a damage to the components.

Figure 7:
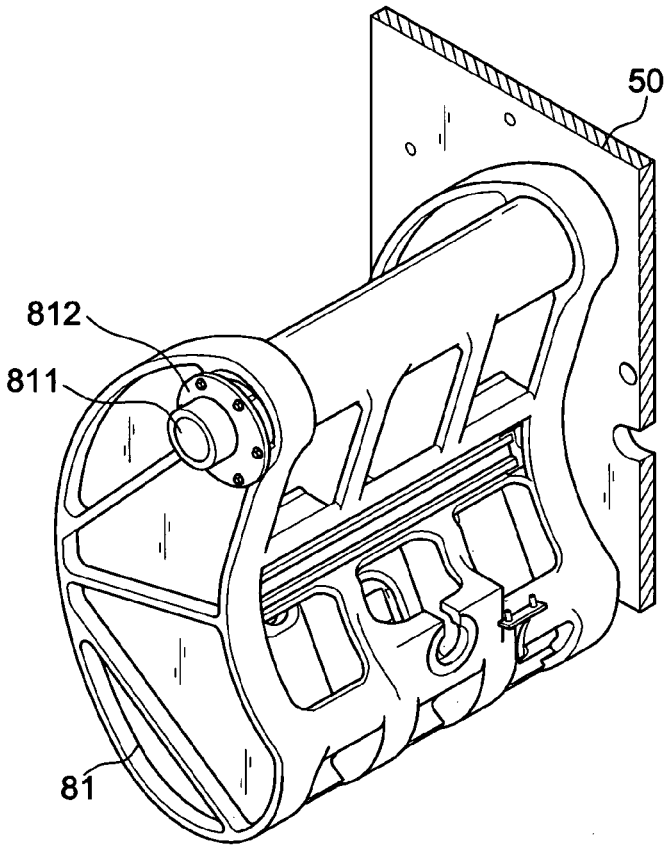
FIG. 7 is a perspective view of a structure of a crush travel adjusting base in accordance with the invention.
Figure 8:
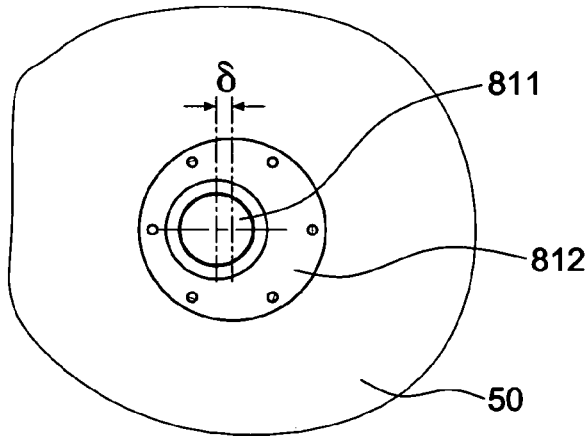
FIG. 8 shows an adjusting status of an eccentric sleeve of a crush travel adjusting base in accordance with the invention.

With reference to FIGS. 7 and 8, the angle of installing the eccentric sleeve 812 to the machine 50 can be adjusted to change the angle of the toggle plate 82 or the crush travel distance. For a crushing substance with a smaller compressive strength, a larger crush travel distance can be chosen to improve the production capacity. For a crushing substance with a higher compressive strength, a smaller crush travel distance can be chosen to lower the load of each component, avoiding damages to components, and enhancing the life of components. Obviously, the effect of adjusting the crush travel distance by an eccentrically set angle is applicable for all kinds of crushing substances.

Figure 9:
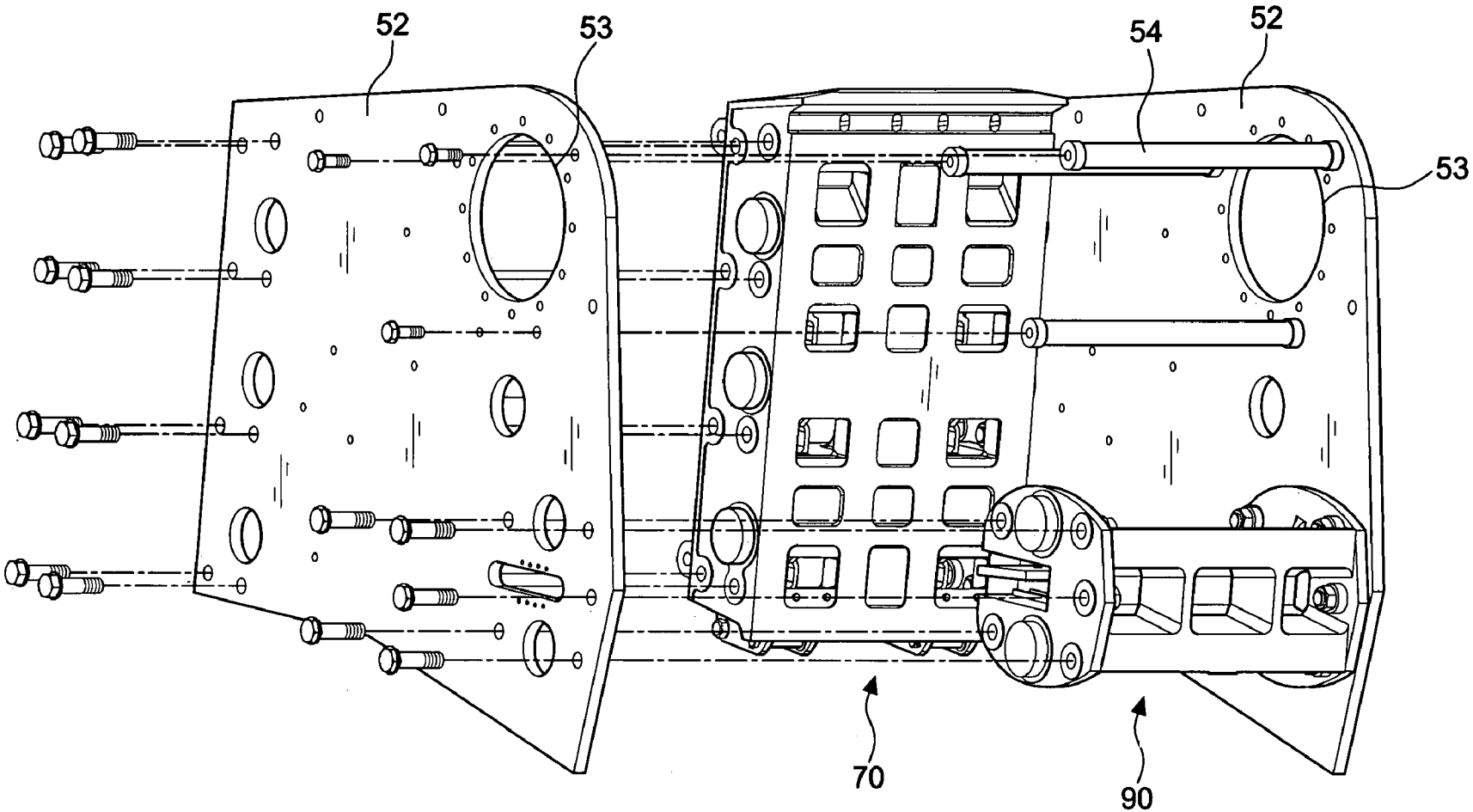
FIG. 9 is an exploded view of a structure of a portion of a machine in accordance with the invention.
Figure 10:
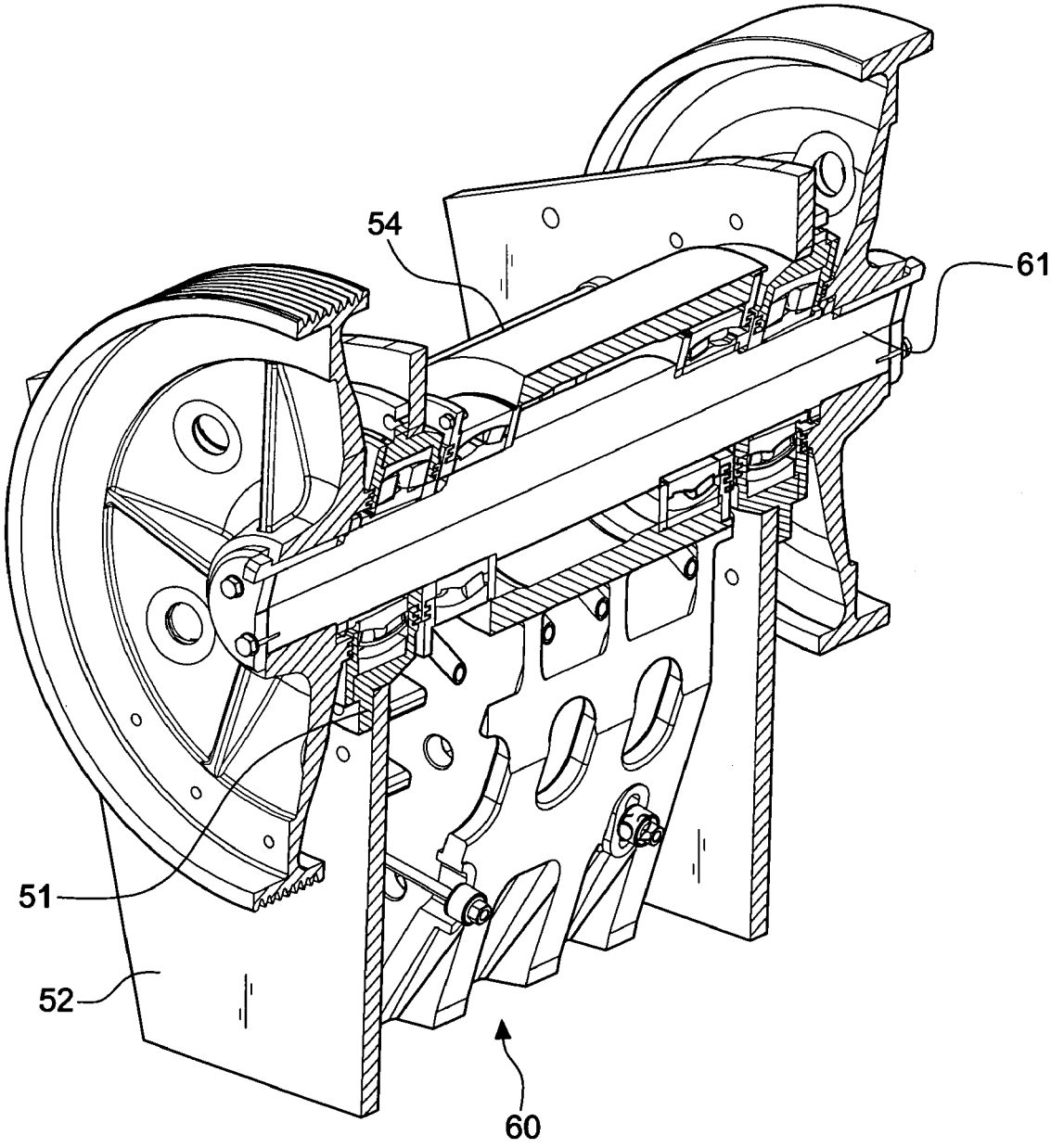
FIG. 10 is a cross-sectional view of Section 10-10 as depicted in FIG. 1.

With reference to FIGS. 9 and 10, the way of installing an eccentric shaft 61 of the moving base 60 to the machine 50 is to fix the bearing housing 51 into a bearing housing hole 53 of an integral sideboard 52 on both sides, and along the periphery of the bearing housing hole 53, and a plurality of support rods 54 are secured uniformly between the two sideboards 52 for providing a uniform support to the bearing housing and improving the rigidity of an frame. However, the machine 50 is comprised of two sideboards 52 installed to the moving base 60 and other sideboards (not shown in the figure) installed at other positions, and the design comes with a modular block installation, so that the components of the machine 50 can be transported separately to a site for its installation, and thus lowering the transportation cost and providing a convenient way of transporting the machine 50.

Based on the aforementioned structure, the automatic crush gap adjusting mechanism 90 of the invention uses the pushing force of the pushing rod 96 to operate together with the pulling force of the pull rod 83 of the moving base and the pull rod 95 of the adjusting base, such that the lateral component force produced by sliding the triangular wedge-shaped lump 92 pushes the steel slot 91 of the stop plate 94 and the stop plate 94, and the deflection of the crush travel adjusting base 81 and the pushing of the toggle plate 82 onto the moving base 60 can be used for setting the crush gap W between the moving die and the fixed die. With such arrangement, the pair of triangular wedge-shaped lumps 92 can be moved to set the crush gap in 1~2 minutes without requiring any other procedure. The invention provides a simple, easy and quick way of setting the crush gap.

With reference to FIGS. 4 and 7, the crush travel adjusting base 81 is comprised of a transverse beam and a slab connected between two arc I-beams, and the position pressed by its corresponding toggle plate 82 is a force exertion point, and the position pressed by the stop plate 94 and disposed between its pivotal shaft and force exertion point is a fixed point. The flexibility of the I-beam allows the crush travel adjusting base 81 to produce a curvature at sections below the fixed point to offset any abnormal load and provide an effect of absorbing an abnormally too-large load.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A jaw crusher, comprising:

a) a moving base, installed to a machine through an eccentric shaft, and having a moving die installed onto a crushing surface;

b) a fixed base, fixed onto the machine, and having a fixed die disposed at a position corresponding to the moving die of the moving base;

c) a crush travel adjusting mechanism, for pivotally coupling the top of a crush travel adjusting base to the machine, and an axle of the crush travel adjusting base being pivotally coupled to the machine through an eccentric sleeve, and a toggle plate being disposed separately on both ends and between the bottom of the crush travel adjusting base and the moving base, and a pull rod of the moving base having a compression spring being provided for tightly pressing front and rear ends of the toggle plate; and d) an automatic crush gap adjusting mechanism having at least one triangular wedge-shaped lump at a position adjusting base of the machine, and a stop plate installed between a steel slotted member disposed adjacent the stop plate and a middle section of the crush travel adjusting base, and using a pull rod of the adjusting base having a compression spring to tightly press front and rear ends of the stop plate to control a position of the triangular wedge-shaped lump and thereby change the position of the steel slotted member to set a crush gap between the moving die and the fixed die.

2. The jaw crusher as recited in claim 1, wherein the moving base pull rod is coupled to the first link rod, and an end of the first link rod is pivotally coupled to a stop plate of the automatic crush gap adjusting mechanism, and another end of the first link rod is coupled to a second rod, and another end of the second rod is coupled to the moving base.

3. The jaw crusher as recited in claim 1, wherein the at least one triangular wedge-shaped lump is designed a pair of triangular wedge-shaped lumps, and each triangular wedge-shaped lump is coupled to a moving end of the pushing rod, and a fixed end of the pushing rod is pivotally coupled to a support stand of the position adjusting base, and the pushing rod is a hydraulic cylinder.

4. The jaw crusher as recited in claim 2, wherein the pull rod of the moving base is coupled to a first link rod, and an end of the first link rod is pivotally coupled to a stop plate of the automatic crush gap adjusting mechanism, and another end of the first link rod is coupled to a second rod, and another end of the second rod is coupled to the moving base.

5. The jaw crusher as recited in claim 4, wherein a blanking shock absorption mechanism installed at a lower lateral side of a blanking opening includes a shock absorption base with an impact plate pivotally coupled to a lower lateral side of the blanking opening, and wherein the shock absorption base is connected to a vibration absorption helical spring in an opposition direction of the impact plate.

6. The jaw crusher as recited in claim 4, wherein the crush travel adjusting base is comprised of a transverse beam and a slab connected between two arc I-beams.

7. The jaw crusher as recited in claim 4, wherein the bearing housing of the machine is fixed to a bearing housing hole of an integral sideboard on both sides, and along the periphery of the bearing housing hole, and wherein a plurality of support rods are secured uniformly between the two sideboards.

8. The jaw crusher as recited in claim 4, wherein the machine is comprised of two sideboards installed at different positions.

* * * * *